US006302711B1

(12) United States Patent
Ito

(10) Patent No.: US 6,302,711 B1
(45) Date of Patent: Oct. 16, 2001

(54) PRINTED BOARD CONNECTOR HAVING CONTACTS WITH BENT TERMINAL PORTIONS EXTENDING INTO AN UNDER SPACE OF THE CONNECTOR HOUSING

(75) Inventor: Masahiro Ito, Ota-ku (JP)

(73) Assignee: Taiko Denki Co., Ltd., Tokyo (JP)

( * ) Notice: Subject to any disclaimer, the term of this patent is extended or adjusted under 35 U.S.C. 154(b) by 0 days.

(21) Appl. No.: 09/062,744

(22) Filed: Apr. 20, 1998

(30) Foreign Application Priority Data

Sep. 8, 1997 (JP) ..... 9-259372

(51) Int. Cl.[7] ..... H01R 12/00
(52) U.S. Cl. ..... 439/83; 439/733.1
(58) Field of Search ..... 439/83, 81, 567, 439/876

(56) References Cited

U.S. PATENT DOCUMENTS 5,145,384 * 9/1992 Asakawa et al. ..... 439/876
5,154,634 * 10/1992 Brown et al. ..... 439/567
5,192,228 * 3/1993 Collinns et al. ..... 439/567
5,257,947 * 11/1993 Scheer et al. ..... 439/567
5,498,174 * 3/1996 Speer et al. ..... 439/567

* cited by examiner

*Primary Examiner*—Brian Sircus
*Assistant Examiner*—J. F. Duverne
(74) *Attorney, Agent, or Firm*—Oliff & Berridge, PLC

(57) ABSTRACT

There is disclosed a printed board connector which inhibits flux from rising in a housing by means of a capillary phenomenon, prevents contacts from being solidified and also prevents solder bridges from being generated. Stands are provided on opposite sides of an under surface of the housing to form an under space common to terminal portions of contacts between the opposite stands.

9 Claims, 4 Drawing Sheets

PRINTED BOARD CONNECTOR HAVING CONTACTS WITH BENT TERMINAL PORTIONS EXTENDING INTO AN UNDER SPACE OF THE CONNECTOR HOUSING

BACKGROUND OF THE INVENTION

1. Field of the Invention

The present invention relates to a printed board connector for making an electrical connection with a printed board.

2. Description of the Related Art

The connector has multiple terminals. A conventional terminal portion of a contact to be connected to a printed circuit on the printed board is not disposed a sufficient space apart from other members. Therefore, at the time of soldering, solder flux flows into the space and causes various problems. For example, as shown in a front view of FIG. 6 and a side view of FIG. 7, a conventional connector is provided with a rectangular parallelepiped housing 1. In the housing 1, female contacts 2 are provided in the front and in the rear as seen in FIG. 6. Plural pairs of the front and rear female contacts 2 are arranged transversely in parallel.

In a fixed portion 3A formed below a contact portion 3, the female contact 2 is pressed into and fixed in a press-in hole 4A of a terminal press-in section 4 which is provided substantially in a central portion along the height of the housing 1. On a terminal portion 5 linearly extended from the fixed portion 3A a terminal leg 5A is formed which is bent orthogonally toward the outside of the housing 1 from a substantially central portion of the terminal portion 5.

Numeral 7 denotes isolation walls which are formed by extended portions of front and rear side walls 1A and extended to under end surfaces 7A of the housing 1. The terminal leg 5A is drawn to the outside from a pull-out groove 8 which is formed between the isolation walls 7. The housing 1 is set on an upper surface of a printed board P. The terminal leg 5A of the female contact 2 is soldered to a printed circuit which is formed on the upper surface of the printed board P.

However, when the housing 1 is set on the printed board P, the under end surfaces 7A of the isolation walls 7 abut on the upper surface of the printed board P. Additionally, both end faces of the terminal leg 5A of the female contact 2 are in contact with or adjacent to both side surfaces 8A of the pull-out groove 8. Also, an upper surface 5B of wind portion of the terminal leg 5A is also in contact with or adjacent to an upper wall surface 8B of the pull-out groove 8.

Therefore, when the terminal leg 5A is soldered to the printed circuit of the printed board P, flux enters the housing 1 via small clearances between the both side surfaces 8A of the pull-out groove 8 and both end faces of the terminal leg 5A and between the upper wall surface 8B and the upper surface 5B of the wind portion. Further, the flux rises along a contact portion between an inner wall surface 1B of the housing 1 and the terminal portion 5 by means of capillary phenomenon. The flux climbs up to an under surface of the terminal press-in section 4 which forms an upper portion of the terminal portion 5.

Also, the female contact 2 is mounted in the housing 1 by cutting the female contact 2 from its carrier and subsequently pressing the female contact 2 into the press-in hole 4A of the terminal press-in section 4. Further, the terminal leg 5A is folded and bent orthogonally toward the outside by using as a guide the under end surface of the upper wall surface 8B of the pull-out groove 8. The terminal leg 5A is thus drawn from the pull-out groove 8 toward the outside. In this case, dispersion arises in the folding and bending angle of the terminal leg 5A. It is difficult to control dimensions of the terminal legs.

Therefore, since a condition of contact with the printed board is varied, soldering is performed non-uniformly. In some case, a connection defect is caused.

The terminal portion 5 of the female contact 2 has an non-plated broken section which is made by cutting the female contact 2 from the carrier. Also, the terminal leg 5A is scratched at the time of a bending process. Therefore, the soldered condition is improper. Further, in some cases the rising flux sticks to the contact portion 3. The movement of the contact portion 3 is restricted. An inserting/pulling force is difficult exerted at the time of engagement with male terminals and at the time of pulling male contacts.

Further, solder (solder paste) passes through the clearance between the under end surface 7A of the isolation wall 7 and the upper surface of the printed board P to short-circuit the adjoining left and right terminal legs 5A. In some cases, a so-called soldered bridge is formed.

Also, in the conventional connector of FIG. 6, a slope 2A of a male contact insertion portion on a head of the female contact 2 is positioned as high as an insertion slope 1D of the housing 1. Therefore, a tilted tip end of the male contact abuts directly on the slope 2A, thereby damaging the female contact 2. When the female contact is repeatedly inserted and pulled out, the tilt is gradually changed. An engagement force of the male contact and the female contact is changed accordingly. Also, right and left holding forces of the tuning-fork shaped right and left contact portions 3 of the female contact are also changed. This easily occurs also when a center line of the slope 2A is not positioned precisely.

An object of the present invention is to solve the aforementioned conventional problems caused by the sticking and rising of the flux.

SUMMARY OF THE INVENTION

To solve this and other objects, in the invention, in an under portion of a housing in which plural contacts having terminal portions extended downward to contact a printed board are held, an under space common to the terminal portions is formed by disposing stands on both side wall ends. The flux is thus prevented from sticking and rising.

Also, in the case that, in the under space, the terminal portions of the plural contacts are folded, bent and pulled out in a position apart from an under surface of the housing, the flux can be more effectively prevented from sticking and rising. Further, by using as a reference surface one side face of a held portion or fixed portion of the contact, the contact is pressed into and held in a press-in hole of the housing. Then, a position of a center line of a tip-end slope can be precisely maintained.

Also, a head slope of a female contact as a female connector having a tuning-fork shaped contact portion deviates below an insertion slope of the housing. Then, the male contact can be prevented from damaging the female contact.

DESCRIPTION OF THE PREFERRED EMBODIMENT

Figure 1:
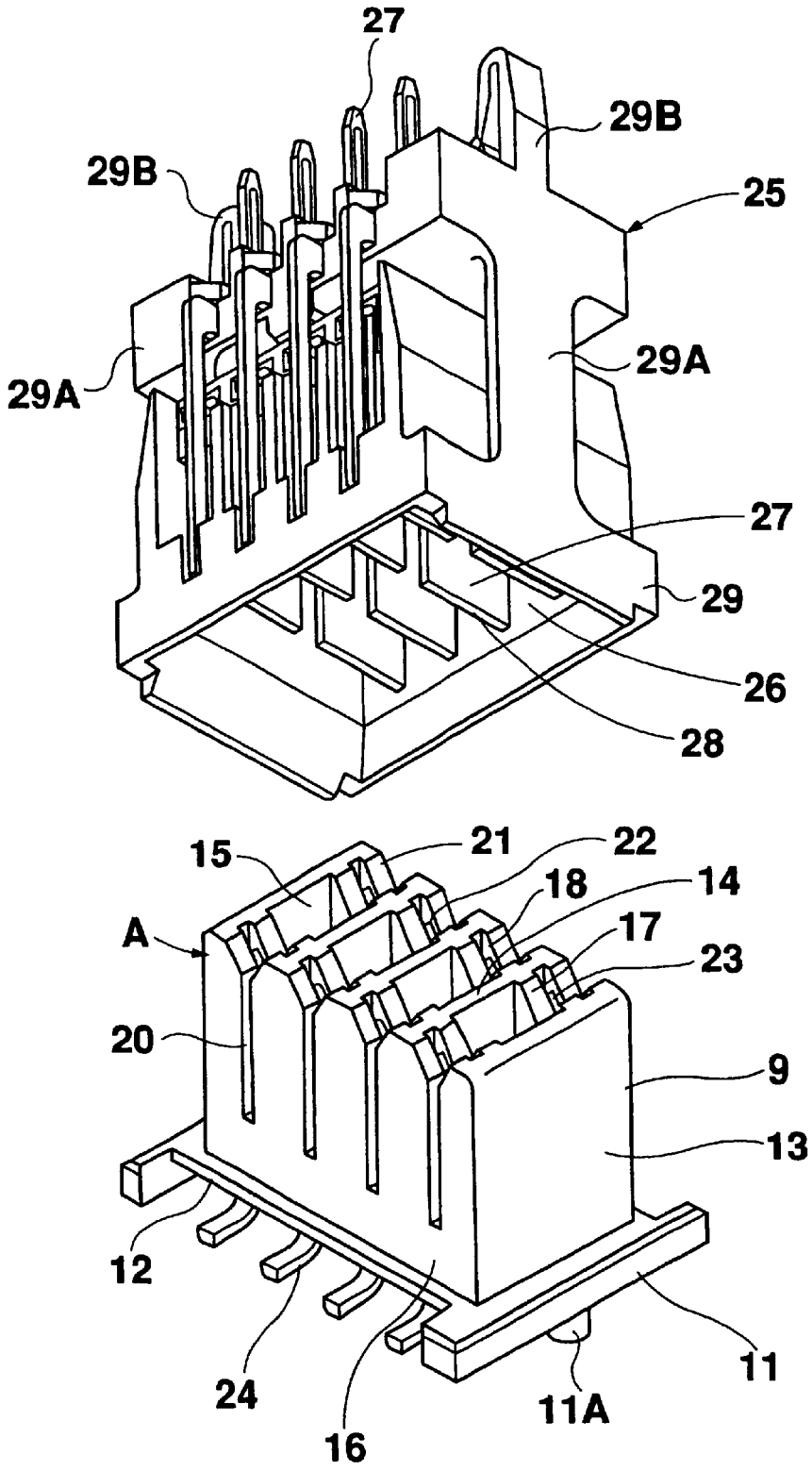
FIG. 1 is a perspective view showing a female connector and a male connector for a printed board according to an embodiment of the invention.
Figure 2:
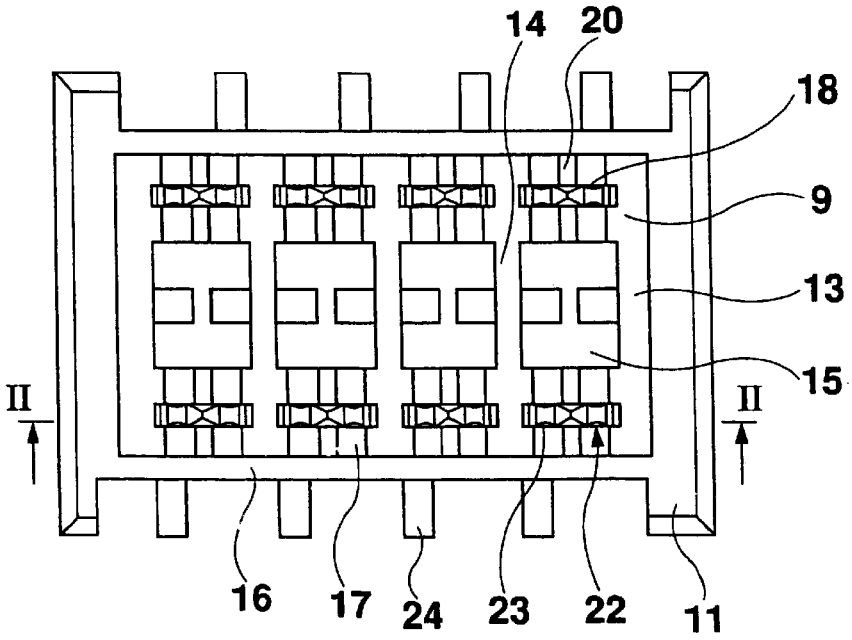
FIG. 2 is a plan view of the female connector shown in FIG. 1.

An embodiment of the invention will be described in detail with reference to FIGS. 1 to 5. In the figures, "A" denotes a female connector for a printed board according to the embodiment. A terminal press-in section 10 (FIGS. 3 and 4) is formed in an under portion of a rectangular parallelepiped housing 9. Additionally, a pair of right and left stands 11 (FIGS. 1 to 3) are integrally formed on both end portions of an under surface of the housing 9, extending in a depth direction (in a front to rear direction).

Therefore, when the female connector A is mounted on a printed board P via both the stands 11 of the housing 9, between an under surface of the terminal press-in section 10 between the stands 11 and an upper surface of the printed board P, an under space 12 is formed at a height of the stand 11.

Numeral 13 denotes side walls for left and right sides of the housing 9. In upper portions of the side walls 13, four open space portions 15 are defined at a depth to the upper surface of the terminal press-in section 10 by partition walls 14 which are parallel with the side walls 13. Also, in the open space portions 15 inside side walls 16 for front and rear sides of the housing 9, side wall blocks 17 are arranged parallel with the side walls 16. Between the side wall block 17 and the opposed side wall 16, a setting groove 18 for a female contact 22 described later is formed a little deeper than the upper surface of the terminal press-in section 10. Additionally, the under portion of the setting groove 18 is connected to the under space 12 via an insertion hole 19 which is vertically extended through the terminal press-in section 10.

Figure 5:
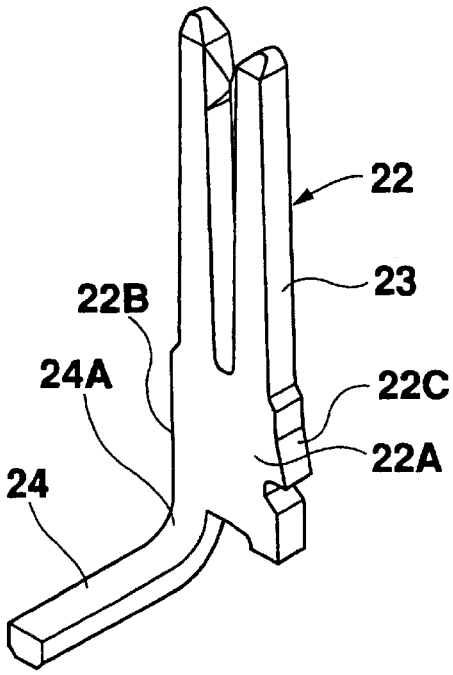
FIG. 5 is a perspective view of a female contact for use in the embodiment.
Figure 6:
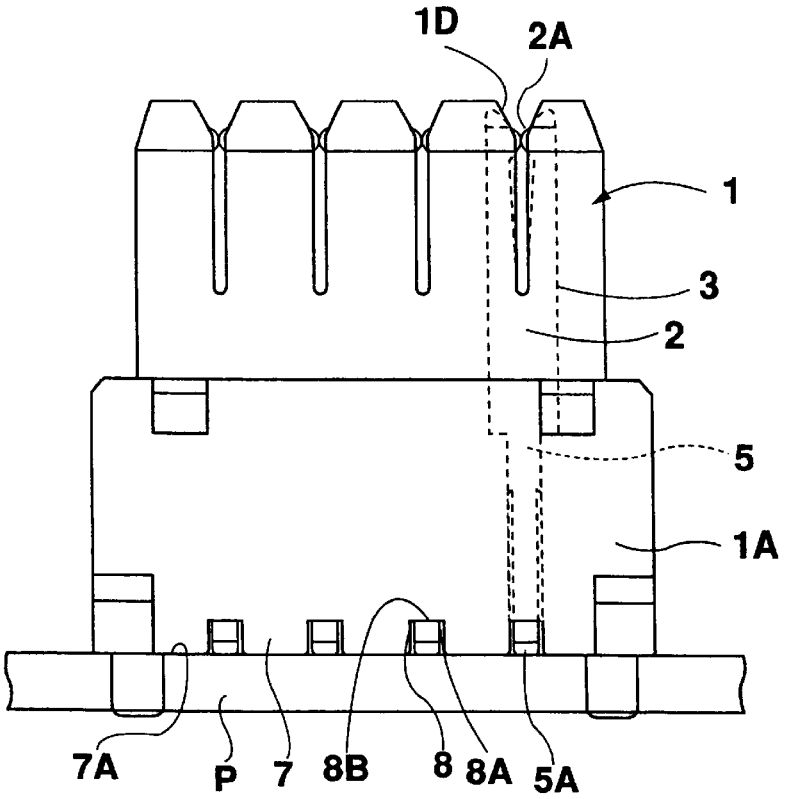
Fig. 6 PRIOR ART
FIG. 6 is a front view of a conventional female connector.
Figure 7:
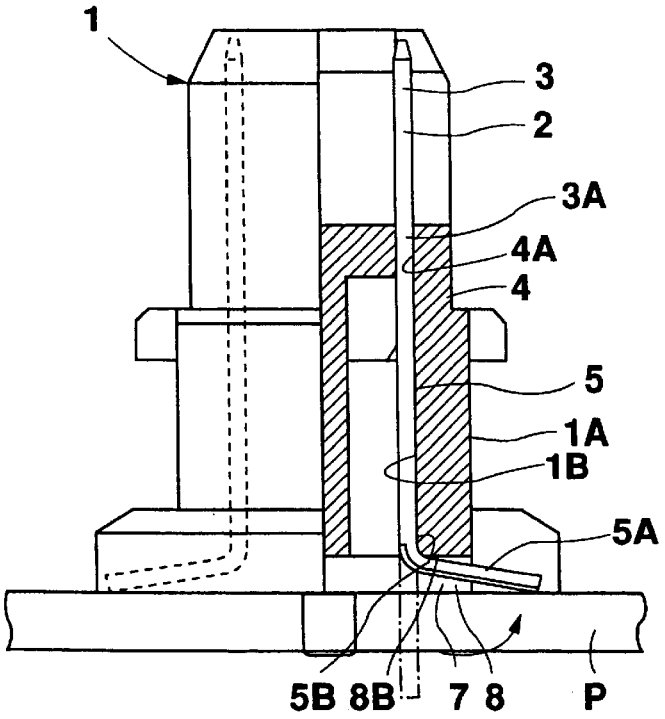
Fig. 7 PRIOR ART
FIG. 7 is a partly cut-away side view of the female connector of FIG. 6.

Numeral 20 denotes a cutting groove which is vertically formed in a central portion between the opposed side walls 16 and between the opposed side wall blocks 17. The cutting groove 20 has the same depth as the setting groove 18. Opposed upper corners of the cutting groove 20 are chamfered obliquely to form insertion slopes 21 on the housing. As shown in FIG. 5, the female contact 22 is a metal plate having elasticity formed into a tuning fork shape. The female contact 22 is provided with an upper half portion of a rectangular contact portion 23, an intermediate portion of a fixed portion 22A and a under half portion of a thin-strip terminal portion 24. The contact portion 23 is branched into two toward its tip end and given elasticity. As seen from FIG. 3, slopes 23A of male contact insertion portions are formed on opposed faces of a head of the contact portion 23. The opposed faces serve as contact portions. The slopes 23A are deviated downward by a distance D shown in FIG. 3 from the housing insertion slopes 21. Thereby, male contacts 27 are guided by the housing insertion slopes 21 before reaching the slopes 23A. Therefore, the contact portions 23 avoid being damaged.

Also, the terminal portion 24 is bent orthogonally from an under end of the fixed portion 22A to the contact portion 23.

Here, the terminal portion 24 of the female contact 22 is bent through a tip bending process by means of a press, and then plated. Thereafter, the fixed portion 22A of the female contact 22 is cut from the carrier. Therefore, the female contact 22 has a good bending precision. When terminals are inserted to the housing 9 as described later, floating of the housing 9 from an under end surface 9A of the terminal press-in section 10 can be controlled. Also, no scratches are made on a bent portion 24A of the terminal portion 24 during the bending process. Additionally, a tip-end surface of the terminal portion 24 is also plated, so soldering is performed effectively.

Figure 3:
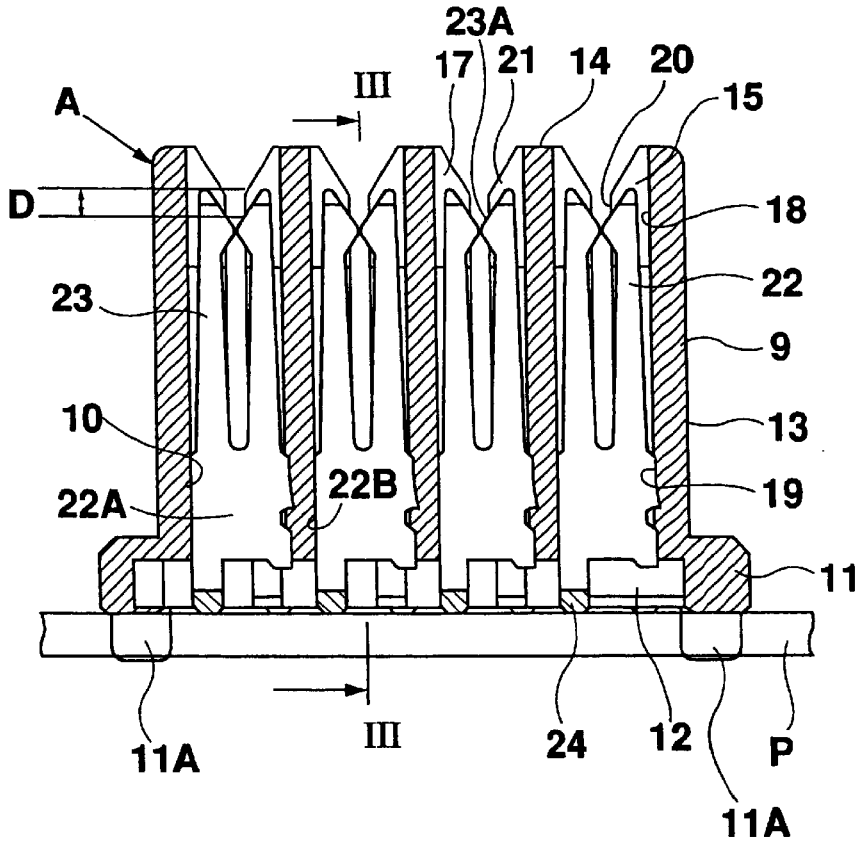
FIG. 3 is a sectional view taken along line II—II of FIG. 2.
Figure 4:
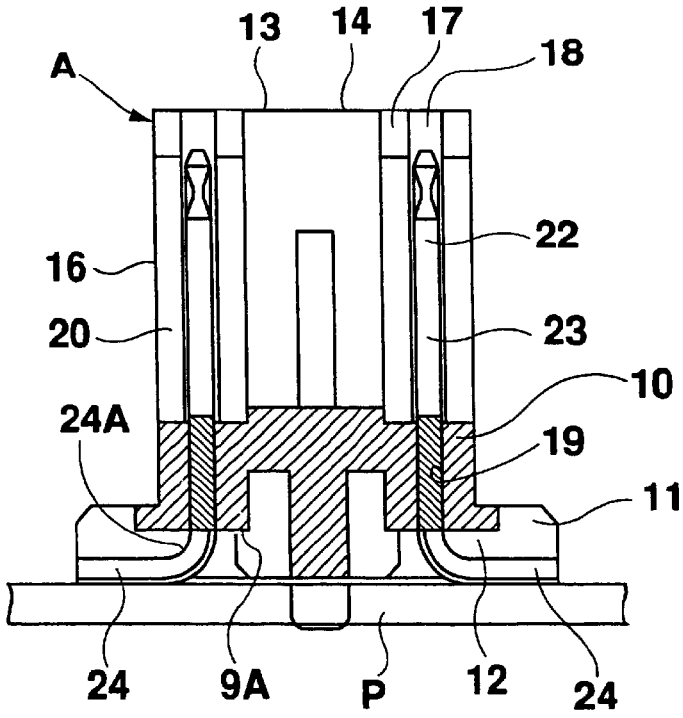
FIG. 4 is a sectional view taken along line III—III of FIG. 3.

The contact portion 23 of the female contact 22 is then inserted from the under end surface 9A of the housing 9 into the setting groove 18 of the housing 9. The fixed portion 22A is fixed in the insertion hole 19 of the terminal press-in section 10. As shown in FIGS. 3 and 5, one side of the fixed portion 22A of the female contact 22 is used as a reference surface 22B, while an opposite surface 22C is partially formed in an arrowhead shape. After insertion, the female contact 22 is prevented from being deviated from its center by the reference surface 22B. The terminal portion 24 is drawn horizontally from the under space 12 of the terminal press-in section 10 to the outside. In this case, in the under space 12 the under end surface 9A of the terminal press-in section 10 is not in contact with the upper surface 24A of the bent portion of the terminal portion 24. Additionally, a space is formed between the terminal portions 24 which are drawn parallel with each other from the under space 12 to the outside.

In FIG. 1, numeral 25 denotes a rectangular parallelepiped male connector which can be engaged with the female connector A. In an under portion of the male connector 25 an inner space portion 26 is provided for engaging with the housing 9 of the female connector A. Inside the inner space portion 26 the male contacts 27 are positioned opposite to the female contacts 22 of the female connector A. Numeral 28 denotes contact portions of the male contacts 27. On right and left side wall rims 29A of a housing 29 legs 29B are formed for fixing the male connector 25 to an opposed printed board.

The female connector A constituted as described above is then mounted on the printed board P via the stands 11 on opposite under ends of the housing 9. The female connector A is fixed to the printed board P with pins 11A protruding from under surfaces of the stands 11 in the same manner as in the conventional art. At this time, the under space 12 is formed as high as the stands 11 between the under surface of the terminal press-in section 10 between the opposite stands 11 and the printed board P.

Subsequently, the terminal portions 24 protruding horizontally from the under space 12 to the outside are soldered to the printed circuit of the printed board P. In this case, the under end surface 9A of the housing 9, i.e., the under end surface 9A of the terminal press-in section 10 does not abut on the upper surface of the bent portion 24A of the terminal portion 24. Additionally, the terminal press-in section 10 is formed in the under portion of the housing 9. Therefore, the flux is inhibited from rising upward from the terminal press-in portion 10 in the housing 9.

Additionally, in the female connector A, between the under end surface 9A of the housing 9 and the upper surface of the printed board P is formed the under space 12. Specifically, the under end surface 9A is mounted above the upper surface of the printed board P. Therefore, the under end surface 9A of the housing 9 does not ride on a soldered base which is printed on the printed circuit of the printed board P. The soldered bridge is reliably prevented from occurring between the terminal portions 24.

Subsequently, when the inner space portion 26 of the male connector 25 is engaged with the housing 9 of the female connector A, the male contacts 27 are guided by the housing slopes 21 and the slopes 23A of the female contacts 22. The contact portions 28 of the male contacts 27 are inserted in the contact portions 23 of the female contacts 22 for electrical connection.

What is claimed is:

1. A printed board connector which comprises:

a plurality of contacts having terminal portions extending downward to contact a printed board, each of the plurality of contacts having only a single bent portion and tuning-fork shaped contact portions; and a housing holding said plurality of contacts and having an under space common to said terminal portions extending downward, said under space being formed directly under, and not extending beyond, an under end surface substantially at a bottom of the housing by stands provided on opposite side wall ends of the housing, each terminal portion of the plurality of contacts positioned at least partially in the under space.

2. The printed board connector according to claim 1, wherein in said under space said terminal portions are bent and extend out from under the under end surface of said housing.

3. The printed board connector according to claim 1, wherein said contacts are pressed into and held by said housing by using as reference surfaces one side face of held portions of said contacts.

4. The printed board connector according to claim 1 wherein said contacts are female contacts of a female connector which have tuning-fork shaped contact portions, and slopes of male contact insertion portions on heads of the contacts are positioned below housing insertion slopes on the said housing.

5. The printed board connector according to claim 3 wherein said contacts are female contacts of a female connector which have tuning-fork shaped contact portions, and slopes of male contact insertion portions on heads of the contacts are positioned below housing insertion slopes on the said housing.

6. A printed board connector comprising:

a plurality of contacts having terminal portions extending downward to contact a printed board, each contact having tuning-fork shaped contact portions; and a housing holding said plurality of contacts and having an under space common to said terminal portions extending downward, said under space being formed directly under, and not extending beyond, an under end surface substantially at a bottom of the housing by stands provided on opposite side wall ends of the housing, each terminal portion of the plurality of contacts positioned at least partially in the under space.

7. The printed board connector of claim 6, wherein the tuning-fork shaped contact portions have male contact insertion portions having, slopes that are positioned below housing insertion slopes on the housing.

8. The printed board connector of claim 6, wherein the contacts are each pressed into and held by said housing by using as reference surfaces one side face of held portions of said contacts.

9. The printed board connector of claim 6, wherein each of the contacts has only a single bent portion.

* * * * *